US007100333B2

(12) United States Patent
Hoberman

(10) Patent No.: US 7,100,333 B2
(45) Date of Patent: Sep. 5, 2006

(54) LOOP ASSEMBLIES HAVING A CENTRAL LINK

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 460 days.

(21) Appl. No.: 10/067,379

(22) Filed: Feb. 5, 2002

(65) Prior Publication Data

US 2002/0112413 A1 Aug. 22, 2002

Related U.S. Application Data

(60) Provisional application No. 60/267,240, filed on Feb. 7, 2001.

(51) Int. Cl.
*E04B 7/08* (2006.01)

(52) U.S. Cl. ..... 52/81.5; 52/64; 52/80.1; 52/81.1; 52/81.3; 52/109; 52/111; 52/641; 52/646; 52/648.1; 52/653.1; 52/745.07; 52/745.08; 52/DIG. 10; 135/25; 135/29; 446/486; 446/487; 446/488; 446/478

(58) Field of Classification Search ..... 52/64, 52/81.3, 109, 111, 641, DIG. 10, 81.5, 80.1, 52/81.1, 653.1, 648.1, 745.08, 745.07, 646; 135/25, 29; 446/486–488, 478
See application file for complete search history.

(56) References Cited

U.S. PATENT DOCUMENTS 3,171,397 A * 3/1965 Sanborn ..... 359/853
3,496,687 A * 2/1970 Greenberg et al. ..... 52/109
3,672,104 A * 6/1972 Luckey ..... 52/109
3,888,056 A * 6/1975 Kelly et al. ..... 52/109
3,977,683 A * 8/1976 Tomura ..... 273/155
4,089,148 A * 5/1978 Oehmsen et al. ..... 52/693
4,468,108 A * 8/1984 Pinsley ..... 254/293
4,942,700 A * 7/1990 Hoberman ..... 52/81.2
4,981,732 A * 1/1991 Hoberman ..... 428/12
5,024,031 A * 6/1991 Hoberman ..... 52/81.2
5,038,532 A * 8/1991 Shahinpoor ..... 52/109
5,056,626 A * 10/1991 Mayr ..... 187/244
5,234,367 A * 8/1993 DeCesare ..... 446/48
5,379,977 A * 1/1995 Ronn et al. ..... 248/277.1
5,448,867 A * 9/1995 Wilson ..... 52/641
5,540,013 A * 7/1996 Diamond ..... 52/70
5,655,558 A * 8/1997 Child ..... 135/97
5,657,584 A * 8/1997 Hamlin ..... 52/81.3
5,761,871 A * 6/1998 Atake ..... 52/653.1
6,082,056 A * 7/2000 Hoberman ..... 52/81.5
6,190,231 B1 * 2/2001 Hoberman ..... 446/487
6,219,974 B1 * 4/2001 Hoberman ..... 52/81.5
6,273,583 B1 * 8/2001 Trisler ..... 362/121
6,488,391 B1 * 12/2002 Gary et al. ..... 362/249
6,563,434 B1 * 5/2003 Olodort et al. ..... 341/22

* cited by examiner

*Primary Examiner*—Carl D. Friedman
*Assistant Examiner*—Christy M. Green
(74) *Attorney, Agent, or Firm*—Gotlieb, Rackman & Reisman, P.C.

(57) ABSTRACT

Improved reversibly expandable structures are formed from novel loop assemblies comprising a plurality of links, each of said links having at least one center pivot joint and a plurality of end pivot joints, each of at least two of said plurality of end pivot joints proximate to the outer edge of said loop assembly and connected to another link; each of said plurality of links being connected to another one of said plurality of links by at least two end pivot joints thereby forming a link pair, said loop assembly comprising at least three link pairs, each of said at least three link pairs connected to at least two other link pairs through at least one of said end pivot joints; each of said at least three link pairs connected to a central piece that is central to the loop assembly, said central piece being rotatable around a central axis, wherein the rotation of the central piece reversibly expands said loop assembly.

20 Claims, 11 Drawing Sheets

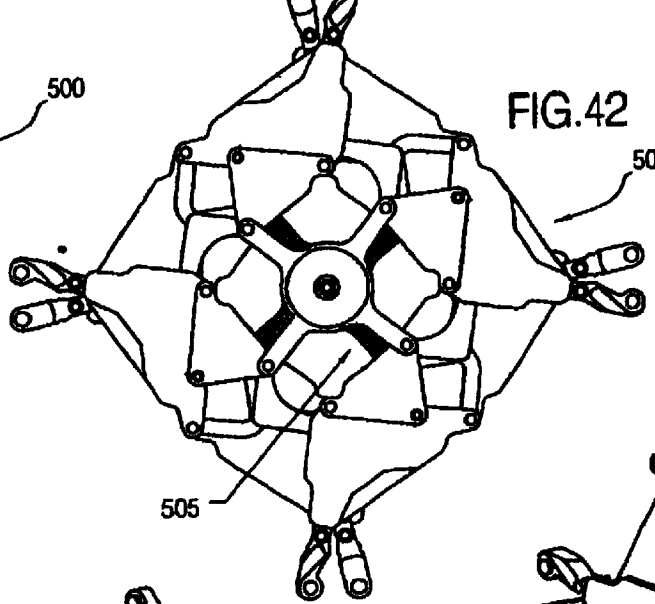
FIG.41
FIG.42
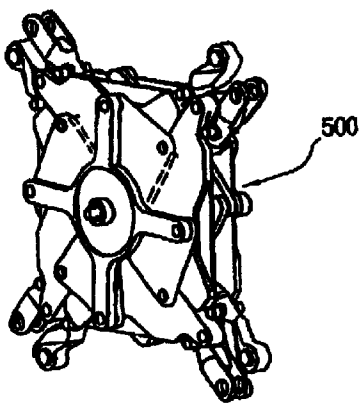
FIG.43
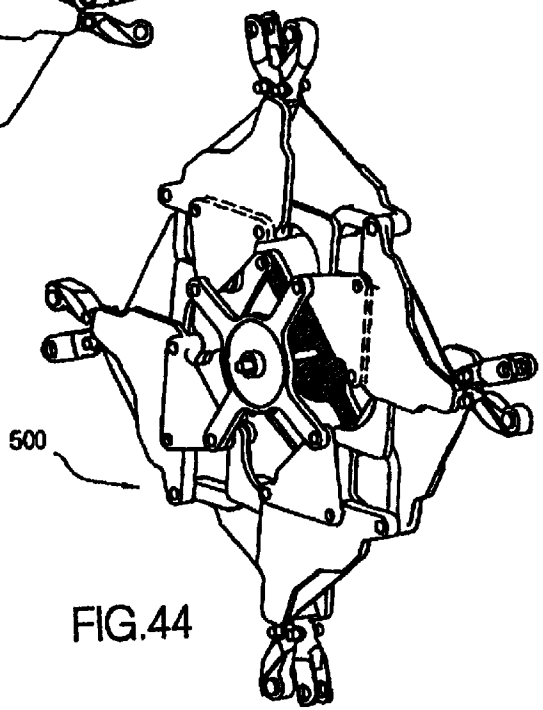
FIG.44

LOOP ASSEMBLIES HAVING A CENTRAL LINK

REFERENCE TO RELATED APPLICATION

This application claims the filing date of provisional patent application, Ser. No. 60/267,240, filed Feb. 7, 2001.

BACKGROUND OF THE INVENTION

U.S. Pat. Nos. 4,942,700, 5,024,031, 6,082,056 and 6,219,974, hereby incorporated by reference as if fully disclosed herein, teach methods for constructing reversibly expandable truss-structures in a wide variety of shapes. The teachings therein have been used to build structures for diverse applications including architectural uses, public exhibits and unique folding toys.

Utilizing the teachings of these patents, self-supporting structures that maintain their overall shape as they expand or collapse in a synchronized manner may be constructed. A basic building block of such structures is a "loop-assembly" which consists of three or more scissor units (disclosed in the '700 and '031 patents) or polygon-link pairs (disclosed in the '056 and '974 patents), each consisting of a pair of links that are pinned together at pivots lying near the middle of each link. Such a loop assembly comprises a ring of interconnected links which can freely fold and unfold. However, at the center of such a ring, a space or void is opened up as the ring expands, resulting in lessened structural stability.

It is, therefore, desirable to provide additional stability and structural stability to such a loop assembly while retaining its ability to expand and contract. It is also desirable to provide a central location to provide a means to mechanically drive the entire assembly.

In accordance with the present invention a novel loop assembly is presented that incorporates an additional useful feature. I have discovered a way to provide a link-pair that lies at the center of the assembly. The middle pivot of this central link-pair is located at the center point of the assembly as a whole. Further, this pivot always maintains its location at the center of the loop assembly as it extends and retracts.

Loop assemblies having such central link-pairs are better stabilized and better self-supported than those without such a feature. The movement of structures built from such assemblies are better synchronized. Further, central link-pairs offer a conveniently placed point of control for folding structures. By simply introducing a rotary motion of one such link relative to its paired link, a force is translated in an even, symmetric fashion to the entire assembly, thereby opening and closing it. Thus, a motor may be conveniently attached to one central link and the motor shaft fixed to the paired central link to provide a well-placed, stabilized means to drive the entire assembly.

Further, in addition to such mechanical improvements, such central link-pairs lead to new functional applications, such as the construction of expanding wheels and spreading mechanisms.

SUMMARY OF THE INVENTION

In accordance with the present invention reversibly expandable structures are formed from loop assemblies comprising interconnected pairs of links which lie essentially on the surface of the structure or parallel to the plane of the surface of the structure. The links in the loop assembly have at least three pivot joints. At least some of the polygon links however, have more than three pivot joints. One of the pivot joints on each link is a pivot joint for connecting to another link to form a link pair. Each link also has at least one internal pivot joint and one perimeter pivot joint. The internal pivot joints are used for interconnecting adjacent link pairs to form the loop assembly. Loop links are additionally joined to a central piece located at the center of the loop assembly. The central piece can be a circular construction with pivot points to which the pivots on the loop links are joined. The rotation of the central piece through a plurality of degrees clockwise and counterclockwise, expands and contracts the entire loop assembly. The central piece can alternatively be constructed of scissor pairs which open and close, resulting in the expansion and contracting of the loop assembly.

Loop assemblies can be joined together and/or to other link pairs through the perimeter pivot joints to form structures.

In one preferred embodiment of the present invention link pairs may be connected to adjacent link pairs to form a loop assembly through hub elements that are connected at the respective internal pivot joints of the two link pairs. Similarly hubs elements can be used to connect loop assemblies together or loop assemblies to other link pairs through the perimeter pivot joints to form structures. In yet another embodiment of the present invention the pivot joints can be designed as living hinges as described more fully below.

Structures built in accordance with the subject invention have specific favorable properties, including: a) The ability to use highly rigid materials rather than bending or distortion of the mechanical links, allowing for a smooth and fluid unfolding process; b) The use of compact, structurally favorable and inexpensive joints in the form of simple pivots; c) Retaining the strength and stability of the structure during folding and unfolding since all movement in the structure is due to the actual deployment process, without floppiness in the structure; d) A wide range of geometries; e) Inexpensive manufacture of structures with flexible hinges that are formed continuously with the links themselves; f) Convenient assembly of structures of many different shapes through kits of the necessary parts; g) The ability to create a space-filling structure by arranging linkages in a three-dimensional matrix; h) Structures have additional stability and structural stability because of the central piece, while still retaining its ability to expand and contract; and i) Structures have a central location to provide a means to mechanically drive the entire assembly.

BRIEF DESCRIPTION OF THE DRAWINGS

FIG. 41 shows a four-sided linkage in a folded position.

FIG. 42 shows the linkage of FIG. 41 in an opened position.

FIGS. 43 and 44 show perspective views of the linkage of FIG. 41 in two positions.

DETAILED DESCRIPTION OF THE INVENTION

Figure 1:
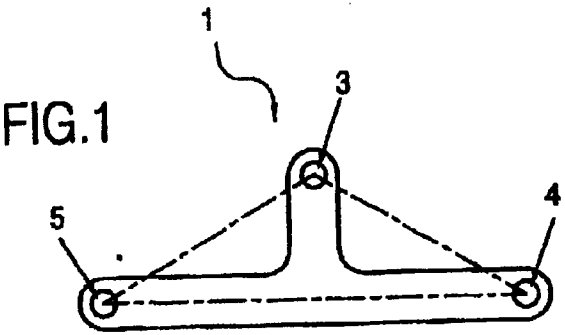
FIG. 1 shows a link 1 having three pivots.

FIG. 1 shows a link 1 having three pivots 3, 4 and 5. Lines connecting these three pivots form an isosceles triangle 13, with pivots 4 and 5 lying on the base and pivot 3 at the apex.

Figure 2:
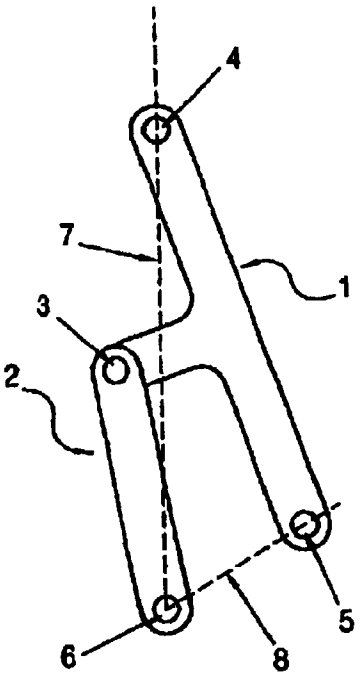
FIG. 2 shows link 1 joined to link 2 by pivot

FIG. 2 shows link 1 joined to link 2 by pivot 3. Link 2 has an additional pivot 6. Pivots 4, 5 and 6 are equidistant from pivot 3. A line 7 is drawn through pivots 4 and 6. A second line 8 is drawn through pivots 5 and 6.

Figure 3:
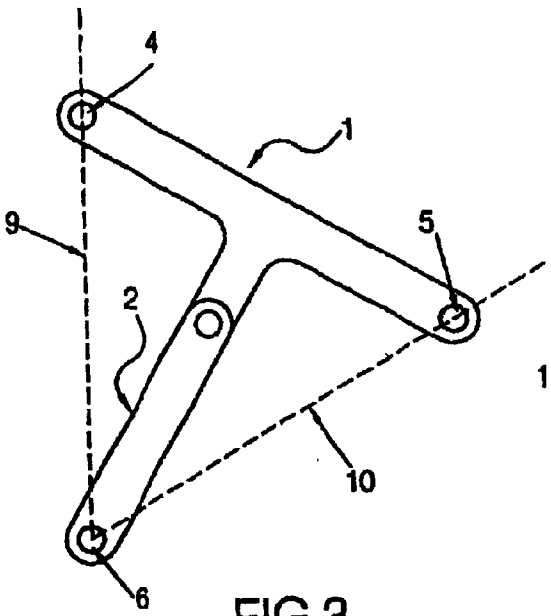
FIG. 3 links 1 and 2 are shown rotated about their common pivot 3 to a different relative position.

In FIG. 3 links 1 and 2 are shown rotated about their common pivot 3 to a different relative position. A line 9 is drawn through pivots 4 and 6. A second line 10 is drawn through pivots 5 and 6. The angle formed between Lines 9 and 10 is identical to the angle formed between lines 7 and 8 as shown in FIG. 1.

Figure 4:
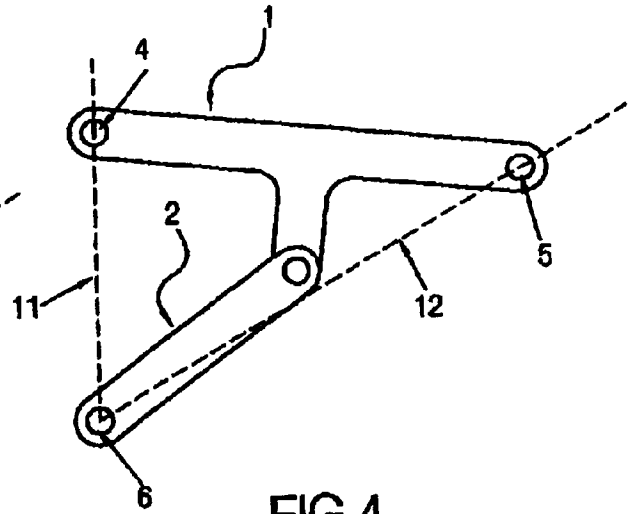
FIG. 4 links 1 and 2 are again shown in a different relative rotational position.

In FIG. 4 links 1 and 2 are again shown in a different relative rotational position. The similarly drawn lines 11 and 12 again form an angle, which is identical to that formed in FIG. 1 and FIG. 2.

In general, given two joined links, the first having three pivots whose center points form an isosceles triangle, the second having two pivots whose distance is identical to the sides of that triangle, which links are joined by the pivot at the apex of the first link, the angle formed by drawing lines that lie on the center points of the three un-joined pivots is constant and unchanging for any relative angle between the two links.

Figure 5:
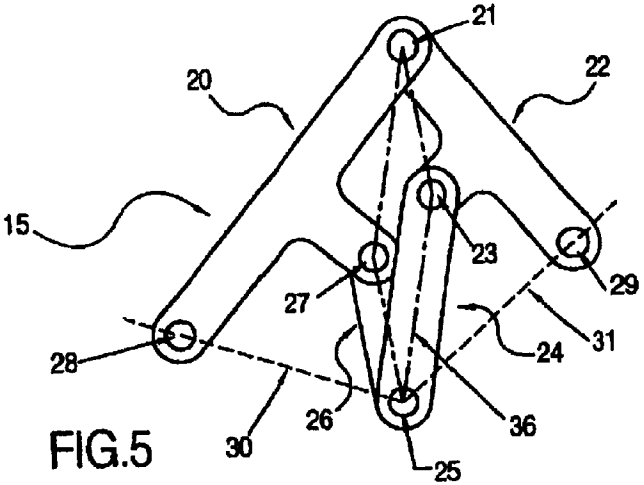
FIG. 5 shows a linkage consisting of four links which are joined in a loop by pivots.

In FIG. 5 a linkage 15 is shown consisting of four links 20, 22, 24 and 26 which are joined in a loop by pivots 21, 23, 25 and 27 respectively. The figure formed by connecting the center points of these four pivots is a parallelogram. Thus the linkage may be seen to be a parallel four-bar.

Link 20 has three pivots 27, 28 and 21 whose center points lie on the vertices of isosceles triangles. Likewise link 22 has three pivots 23, 29 and 21 which form an isosceles triangle, which is similar, but of a different size, than that triangle formed by link 20. Line 30 is drawn through pivots 28 and 25. Line 31 is drawn through pivots 29 and 25.

Figure 6:
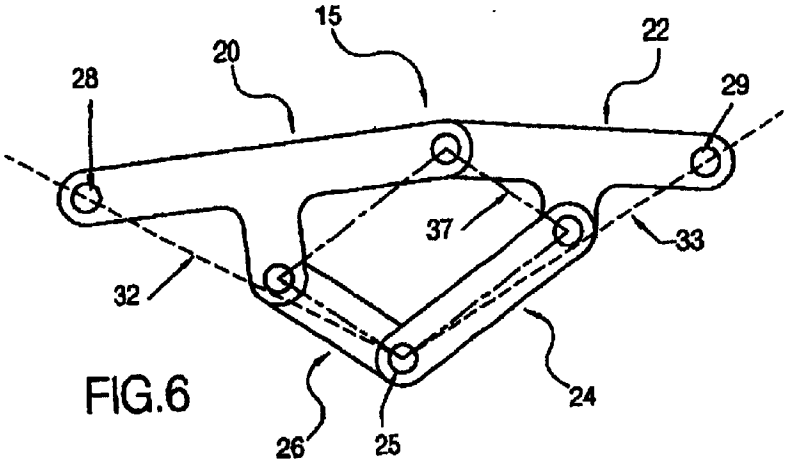
FIG. 6 shows the linkage of FIG. 5 in a different position.

FIG. 6 shows the linkage 15 in a different position. Lines 32 and 33 are drawn through pivots 28, 25 and 29, 25 respectively. The angle formed between lines 30 and 31 shown in FIG. 5 is identical to the angle formed between lines 32 and 33 shown in FIG. 6.

In general, given a parallel four-bar linkage, each link being joined to two neighboring links, where two of the links have an additional pivot each of which form an isosceles triangle with the other two pivots of that link, which two triangles thus formed are similar, the lines drawn between each of those additional pivots and the pivot connecting the two links opposite forms an angle which is constant and unchanging for any relative position of the linkage.

Figure 7:
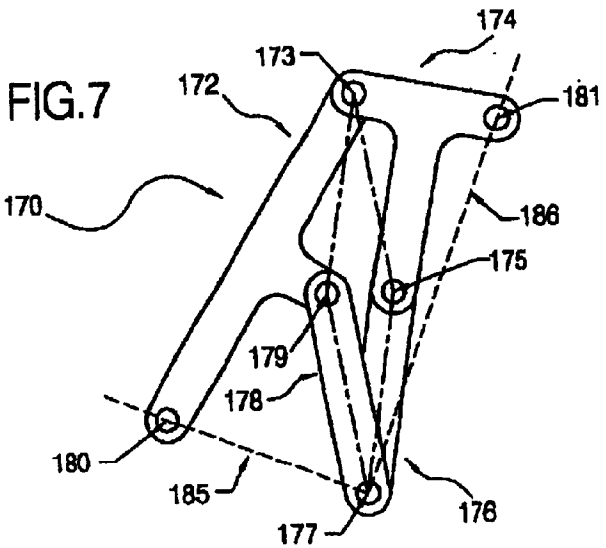
FIG. 7 shows a linkage consisting of four links which are joined in a loop by pivots.

In FIG. 7 a linkage 170 is shown consisting of four links 172, 174, 176 and 178 which are joined in a loop by pivots 173, 175, 177 and 179 respectively. The figure formed by connecting the center points of these four pivots is a rhomb. Thus the linkage may be seen to be a parallel four-bar with equal sides.

Link 172 has three pivots 179, 173 and 180 whose center points lie on the vertices of isosceles triangles. Likewise link 174 has three pivots 175, 181 and 173 which form an isosceles triangle which is whose sides are the same length as that triangle formed by link 172, but whose base is of different length. Line 185 is drawn through pivots 180 and 177. Line 186 is drawn through pivots 181 and 177.

Figure 8:
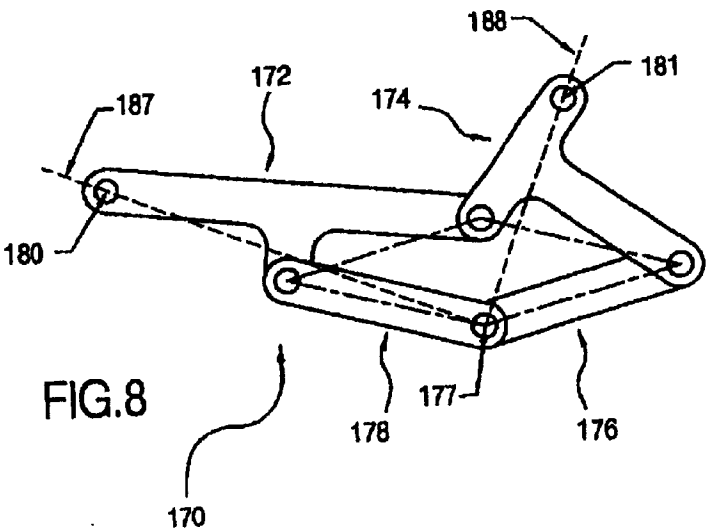
FIG. 8 shows the linkage of FIG. 7 in a different position.

FIG. 8 shows the linkage 170 in a different position. Lines 187 and 188 are drawn through pivots 180, 177 and 181, 177 respectively. The angle formed between lines 187 and 188 shown in FIG. 7 is identical to the angle formed between lines 186 and 185 shown in FIG. 8.

In general, given a equal-sided parallel four-bar linkage, each link being joined to two neighboring links, where two of the links have an additional pivot each of which form an isosceles triangle with the other two pivots of that link, which two triangles thus formed have equal length sides, but bases of different lengths, the lines drawn between each of those additional pivots and the pivot connecting the two links opposite forms an angle which is constant and unchanging for any relative position of the linkage.

Figure 9:
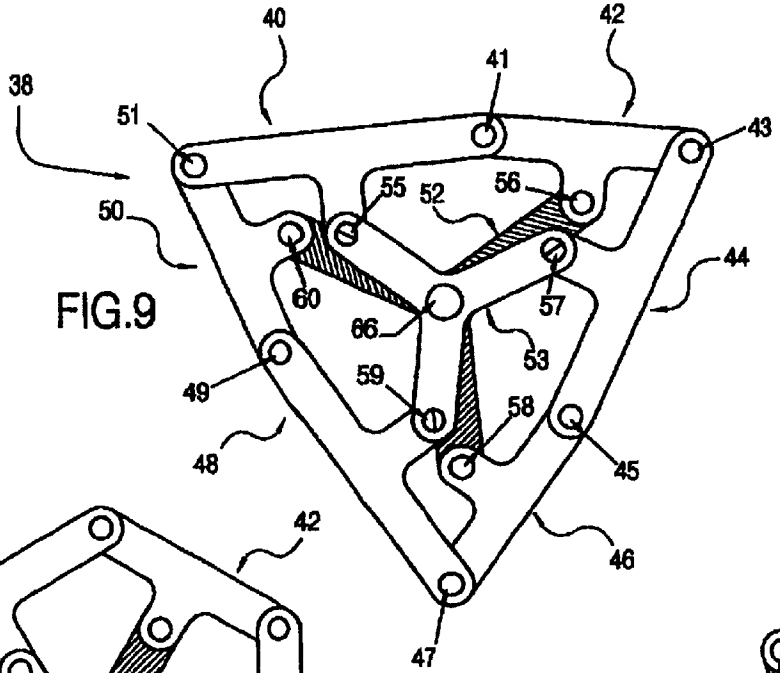
FIG. 9 shows a linkage consisting of six links joined in a loop arrangement via pivots.

In FIG. 9 a linkage 38 is shown consisting of six links 40,42,44,46,48 and 50 joined in a loop arrangement respectively via pivots 41,43,45,47,49 and 50. Link 40 may be seen to have three pivots: 51, 41 and 55. Pivots 51 and 41 lie towards the perimeter of the loop assembly, while pivot 55 lies towards the interior of the loop assembly. Thus pivots of each of these types shall be hereinafter referred to as perimeter pivots and interior pivots respectively. Additionally to interior pivot 55, there are five other interior pivots 56,57,58,59 and 60.

Linkage 38 is further comprised of two centrally located links 64 and 65. Three interior pivots 55,57 and 59 respectively connect links 40,44 and 48 to central link 64. Three other interior pivots 56,58 and 60 respectively connect links 42, 46 and 48 to central link 65. Central links 64 and 65 are themselves attached by pivot 66.

Thus linkage 38 may be seen to consist of a region of outer links and central links. The outer links have, in general, perimeter pivots, which serve to connect them into a loop arrangement, and interior pivots which server to connect the outer links to the central links. The central links are pivotally attached to each other via a central pivot.

Figure 10:
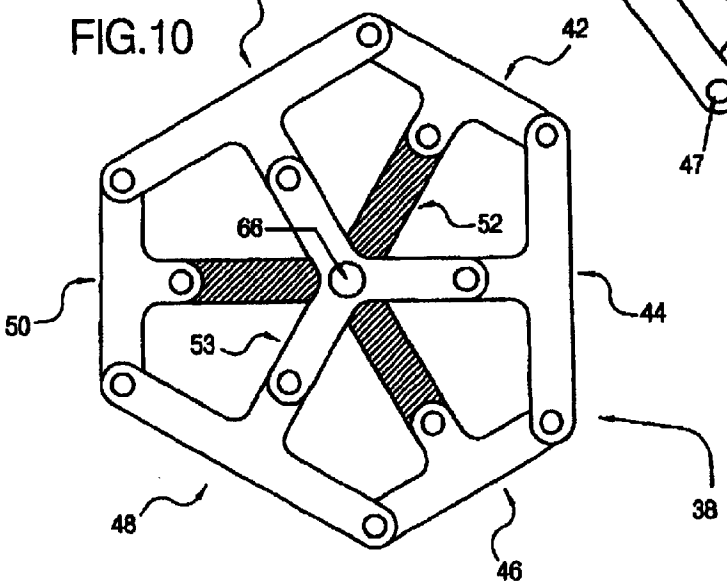
FIG. 10 shows the linkage of FIG. 9 in a different position.
Figure 11:
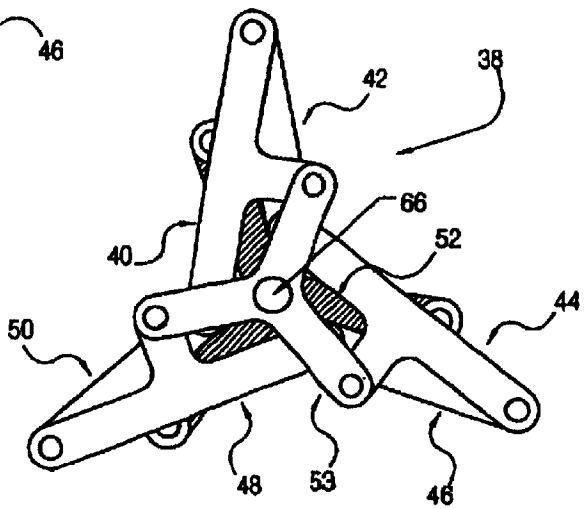
FIG. 11 shows the linkage of FIG. 9 in yet another different position.

FIG. 10 shows linkage 38 in a different position; FIG. 11 shows linkage 38 in yet another different position. For each position of the linkage, central links 64 and 65 can provide a convenient and stable point to drive the linkage; simply by rotating these two links relative to each other, forces will be transmitted to the outer links in a symmetric fashion.

Figure 12:
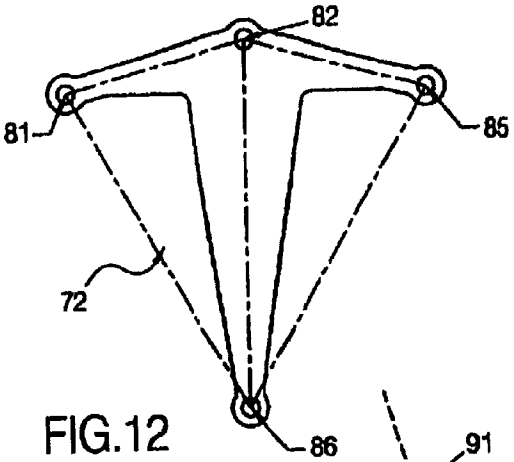
FIG. 12 shows a link having four pivots that form an isosceles triangle and pivots that lie on a second triangle that is the mirror image of the first triangle formed.

FIG. 12 shows a link 72 having four pivots 81, 82, 85 and 86. Pivots 81, 82 and 86 form an isosceles triangle and pivots 85, 82 and 86 lie on a second triangle that is the mirror image of the first triangle formed.

Figure 13:
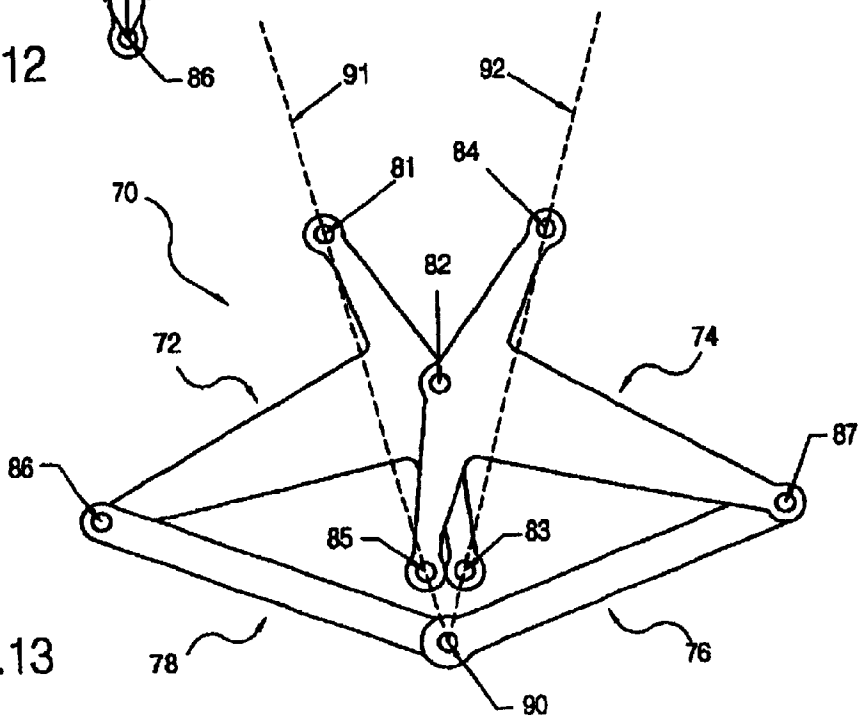
FIG. 13 shows a linkage, which is an alternate embodiment of the invention.

FIG. 13 shows a linkage 70, which is an alternate embodiment of the invention. Linkage 70 comprised of four links 72, 74, 76 and 78, which are connected together by pivots 82, 87, 90 and 86 to form a parallel four-bar linkage. Like link 72, link 74 has four pivots 82, 87, 84 and 85, which lie on the vertices of mirrored isosceles triangles. Line 91 is drawn between pivot 81 and 85. Line 92 is drawn between pivot 84 and 83. The intersection of lines 91 and 92 is at the center point of pivot 90.

Figure 14:
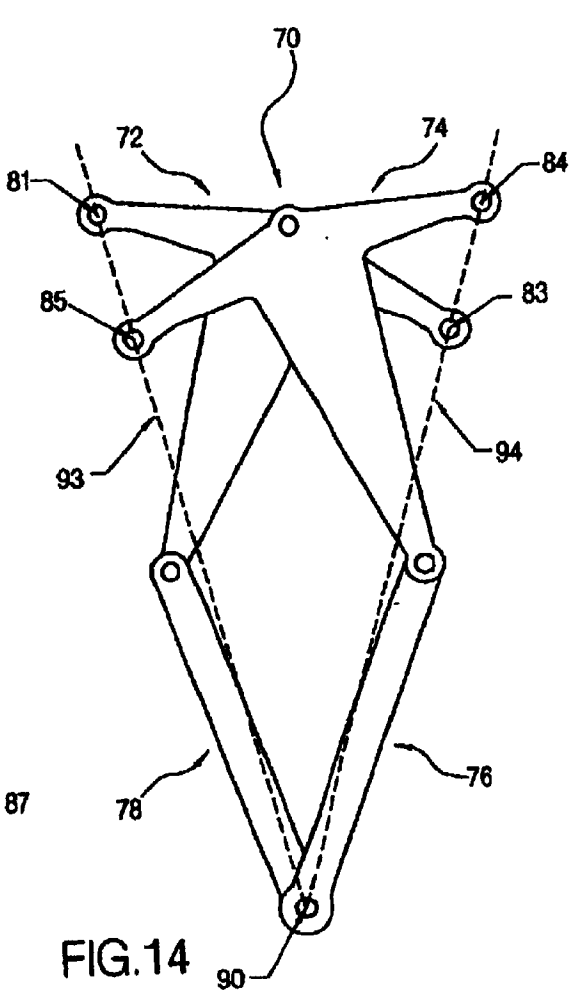
FIG. 14 shows the linkage of FIG. 13 drawn in a different position.

FIG. 14 shows linkage 70 drawn in a different position. Line 93 passes through pivots 81 and 85. Line 94 passes through pivots 84 and 83. The intersection of lines 93 and 94 is again at the center point of pivot 90, which lies opposite the two four-pivot links 72 and 74. The angle formed between lines 93 and 94 is identical to that formed between line 91 and 92 in FIG. 13.

In general, given an equal-sided parallel four-bar linkage where two of the links each have two pivots, and two other links each have four pivots which lie on the vertices of two mirrored isosceles triangles, and of those four pivots, two lie on the mirror line and are attached to neighboring links, and two are side pivots which remain unattached, two lines may be drawn each connecting between the side pivots of neighboring links, which two lines will form an angle that is constant and unchanging for any relative position of the linkage, and will always intersect that pivot which lies opposite the two four-pivot links.

Figure 15:
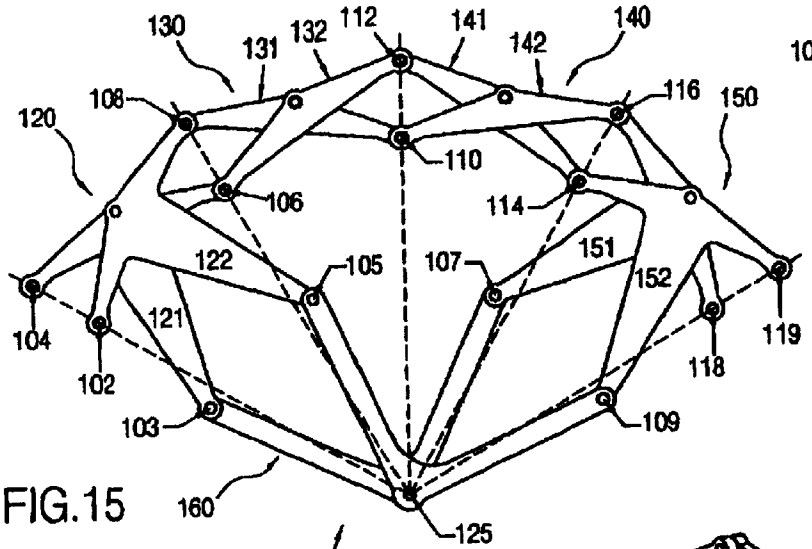
FIG. 15 shows a linkage consisting of five scissor pairs.

FIG. 15 shows a linkage 100 consisting of five scissor pairs 120, 130, 140, 150 and 160. Each Scissor pair is comprised of two links joined by a centrally located pivot. For example, scissor pair 120 is comprised of links 121 and 122 joined by pivot 103, the others are similarly formed.

Based on their general position and function, scissor-pairs 120, 130, 140 and 150 shall be referred to as perimeter scissor-pairs, whereas 160 shall be referred to as a central scissor pair.

The links in scissor-pair 120 and 150 each have four pivots. They are joined both to their neighboring scissor-pairs—130 and 140 respectively—and to the central scissor pair 160. They are thus called centrally attached perimeter pairs. The links in scissor pairs 130 and 140 each have three pivots. They are joined only to their neighboring perimeter pairs, and are thus not centrally attached. A line drawn through side pivots 104 and 102 intersects central pivot 125. Likewise, lines drawn through 106,108 and 110,112 and 114,116 and 118,119 respectively all intersect central pivot 125.

Figure 16:
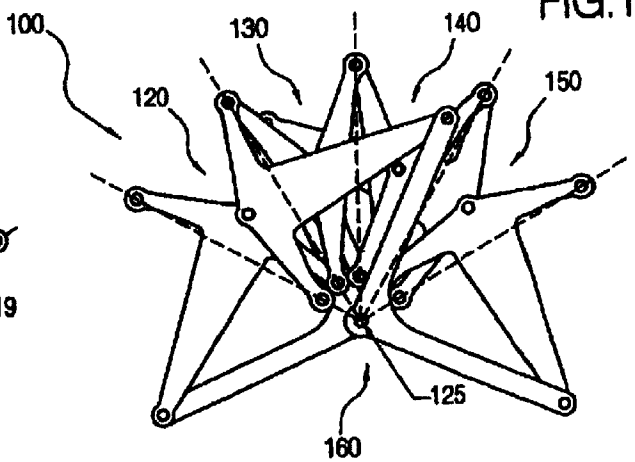
FIG. 16 shows the linkage of FIG. 15 in a different position.

FIG. 16 shows linkage 100 in a different position. The five lines drawn through side pivots 102,104 and 106,108 and 110,112 and 114,116 and 118,119 respectively all intersect central pivot 125.

Figure 17:
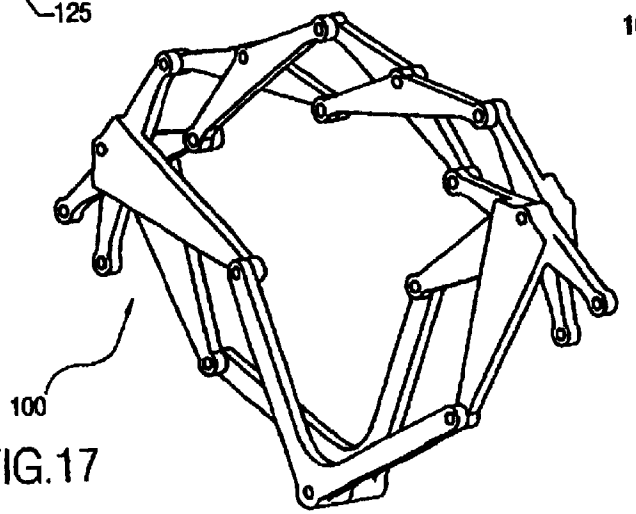
FIGS. 17 and 18 show the linkage of FIG. 15 in perspective views.
Figure 18:
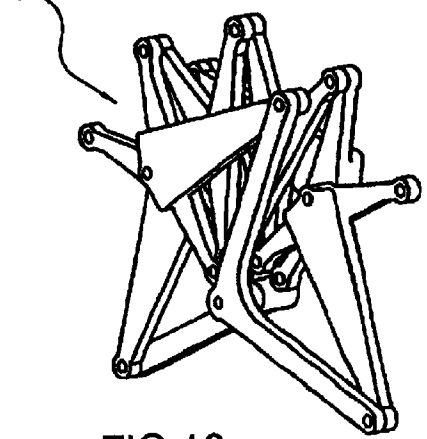

FIGS. 17 and 18 show linkage 100 in perspective views.

Figures 19, 20, 21, 22, 23, 24:
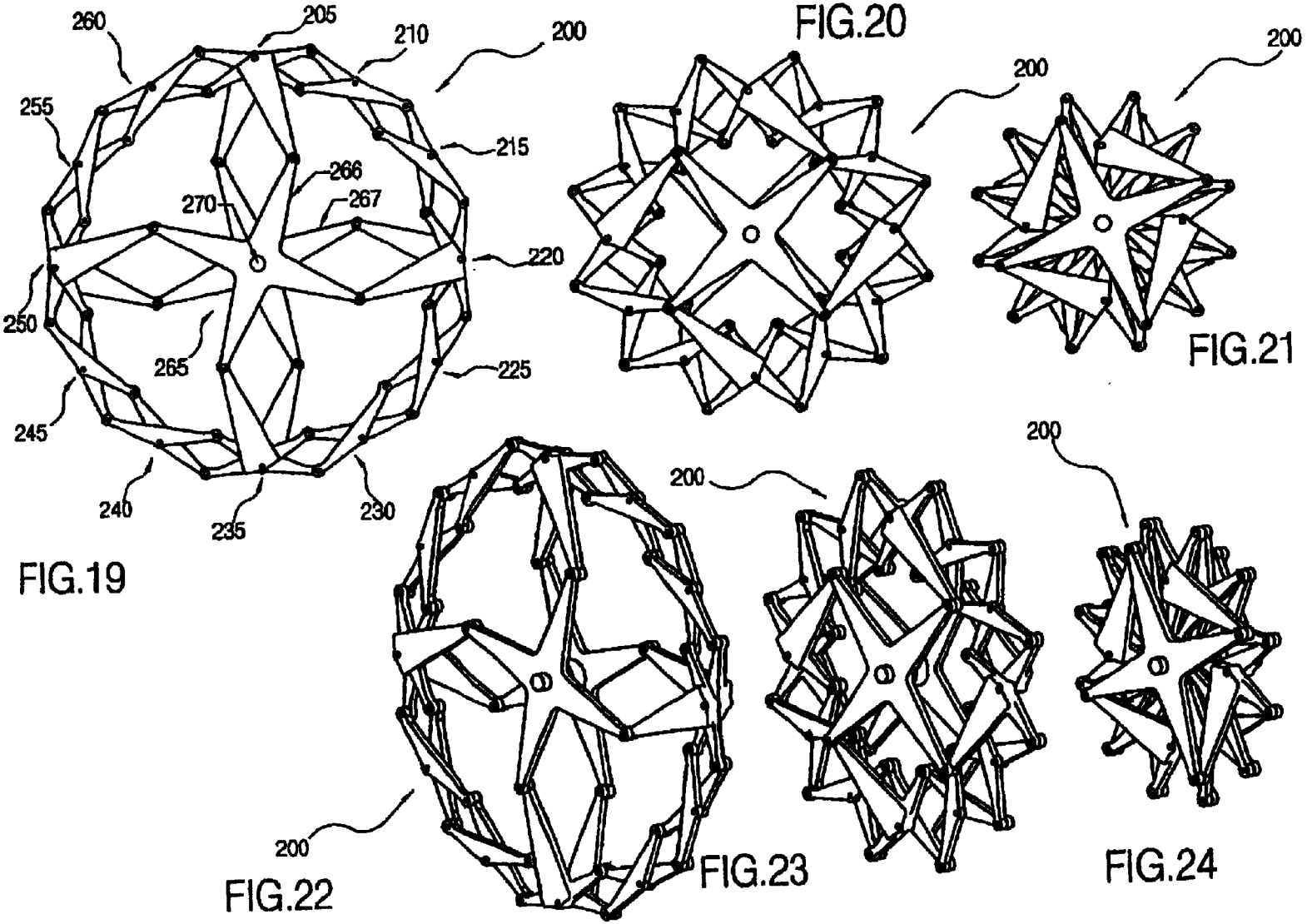
FIG. 19 shows a linkage consisting of thirteen scissor pairs.
FIGS. 20 and 21 the linkage of FIG. 19 in two different positions.
FIGS. 22, 23 and 24 show perspective views of the linkage of FIG. 19 in different positions.

FIG. 19 shows a linkage 200 consisting of thirteen scissor pairs. There are twelve perimeter scissor-pairs forming a complete loop-assembly. Four perimeter pairs 205, 220, 235 and 250 are centrally attached. Eight perimeter pairs 210, 215, 225, 230, 240,245, 255, 260 are not centrally attached. The thirteenth scissor pair 265 is comprised of two links 266 and 267, which are attached by center pivot 270. Pair 265 is pivotally attached by a total of eight pivots to pairs 205, 220,235 and 250.

FIGS. 20 and 21 shows linkage 200 in two different positions. By rotating links 266 and 267 relative to one another, central scissor pair 265 may be seen to drive the entire assembly in a symmetric and stable fashion. Center pivot 270 remains at the geometric center of the entire assembly in all positions.

FIGS. 22, 23 and 24 show perspective views of linkage 200 in different positions.

Figures 25, 26, 27, 28, 29, 30, 31:
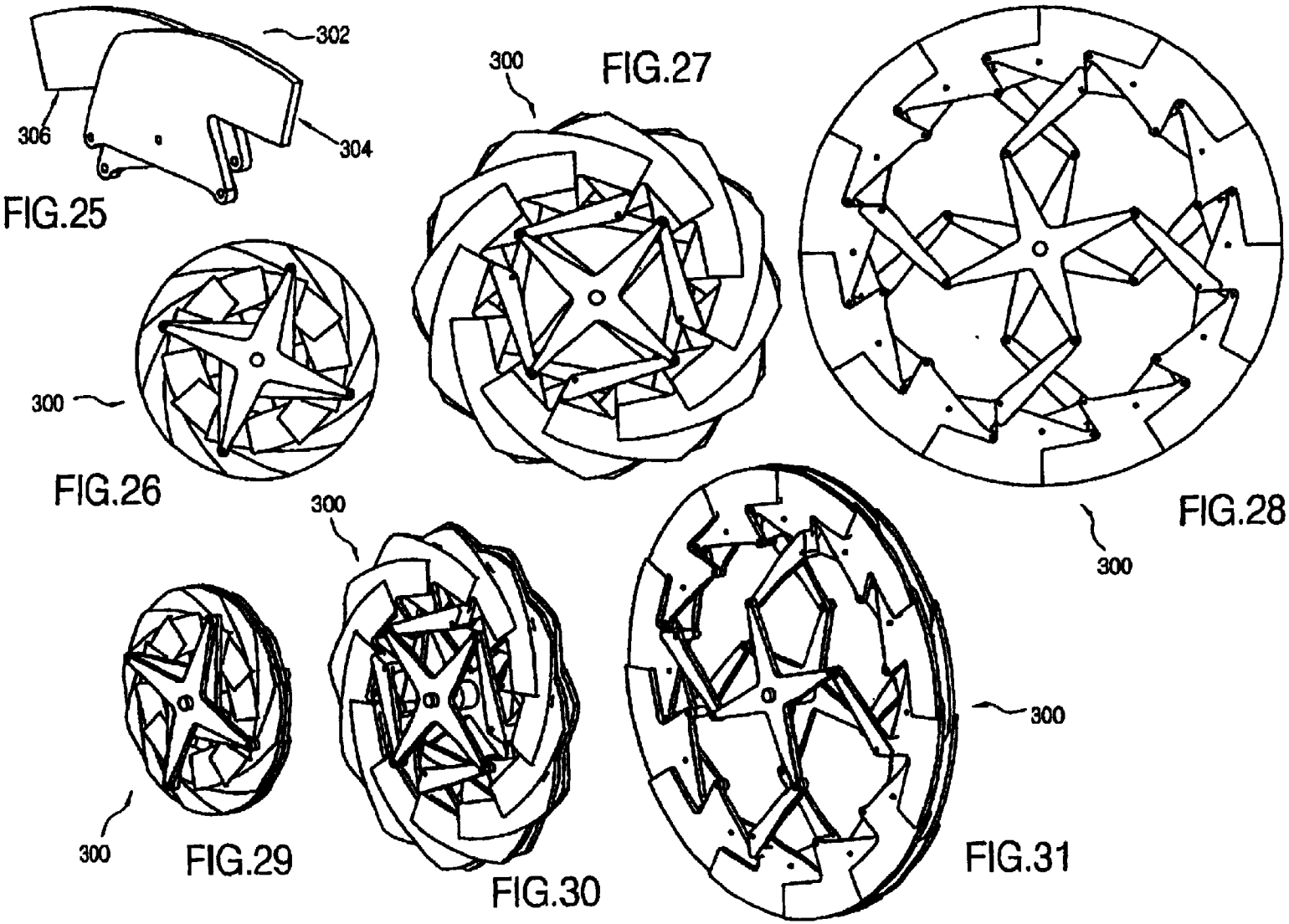
FIG. 25 shows a scissor pair comprised of two links which have a different profile than those shown in the previous drawings.
FIG. 26 shows a linkage comprised of twelve perimeter scissor pairs and one central scissor pairs, all of whose pivot locations are similarly distributed to the linkage in FIG. 19.
FIG. 27 shows the linkage of FIG. 26 in a partially expanded position.
FIG. 28 shows the linkage of FIG. 26 in a fully expanded position, an embodiment of the invention as an expanding wheel.
FIGS. 29, 30 and 31 each show a perspective view of the linkage of FIG. 26.

FIG. 25 shows a scissor pair 302 comprised of two links 304 and 306, which links have a different profile than those shown in the previous drawings.

FIG. 26 shows a linkage 300 comprised of twelve perimeter scissor pairs and one central scissor pairs, all of whose pivot locations are similarly distributed to linkage 200. Due to the different profile of the individual links, the overall shape of the linkage is a circle.

FIG. 27 shows linkage 300 in a partially expanded position. FIG. 28 shows linkage 300 in a fully expanded position. In this position the overall shape of the linkage is a circle. Thus linkage 300 shows an embodiment of the invention as an expanding wheel.

FIGS. 29, 30 and 31 each show a perspective view of the linkage 300.

Figures 32, 33, 34, 35, 36, 37, 38:
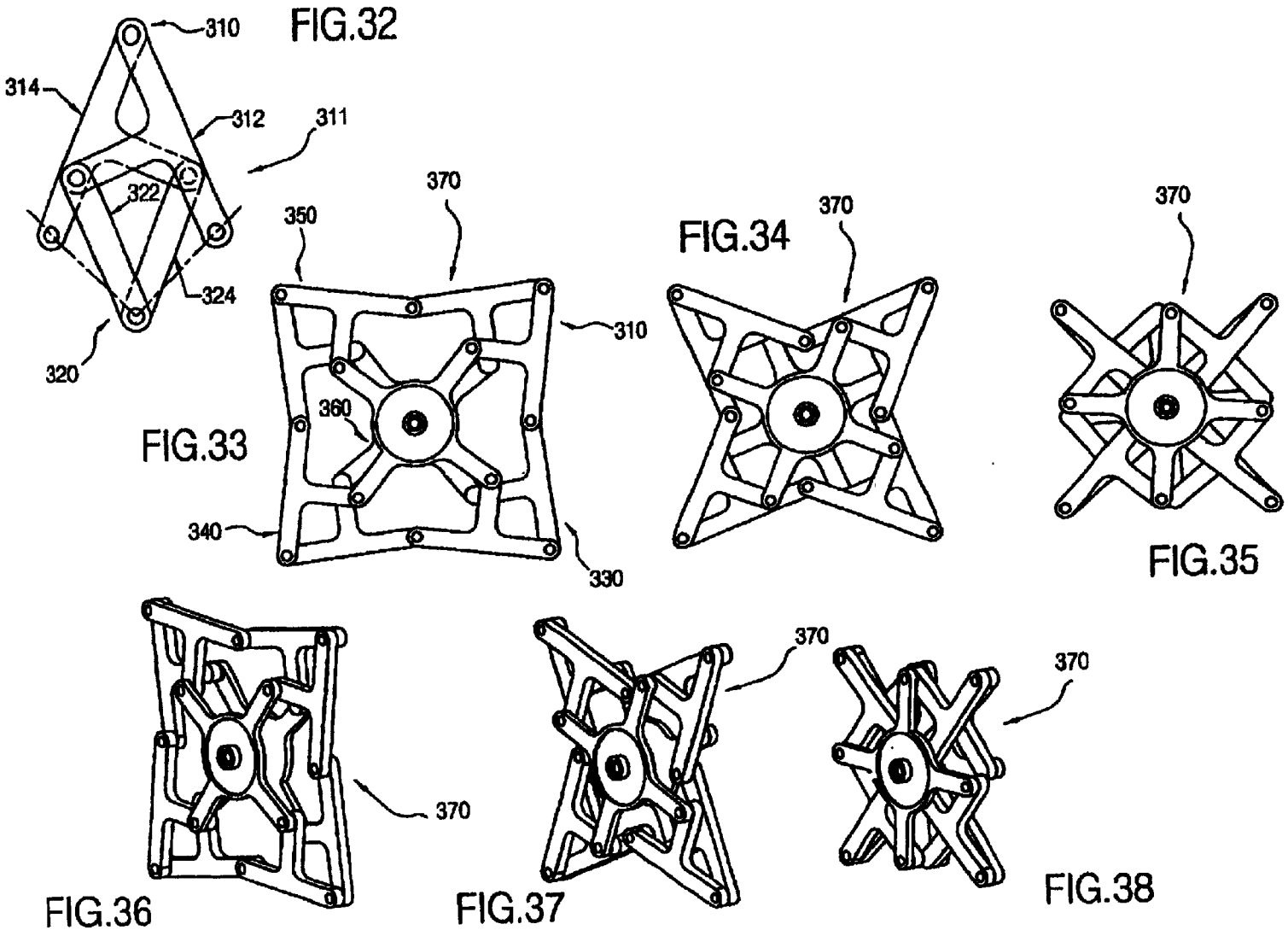
FIG. 32 shows an alternate embodiment of the invention consisting of two scissor pairs which form a four bar linkage.
FIG. 33 shows a four sided linkage consisting of four perimeter scissor-pairs and one central scissor pair.
FIGS. 34 and 35 show the linkage of FIG. 33 in two different positions.
FIGS. 36, 37 and 38 show perspective views of the linkage of FIG. 33 in different positions.

FIG. 32 shows an alternate embodiment of the invention consisting of two scissor pairs 310 and 320 which form a four bar linkage 311.

In FIG. 33 a four sided linkage 370 is shown consisting of four perimeter scissor-pairs 310, 330, 340 and 350 and one central scissor pair 360. FIGS. 34 and 35 show linkage 370 in two different positions. The center pivot of central scissor pair 360 always remains in the center of the linkage.

FIGS. 36, 37 and 38 show perspective views of linkage 370 in different positions.

Figure 39:
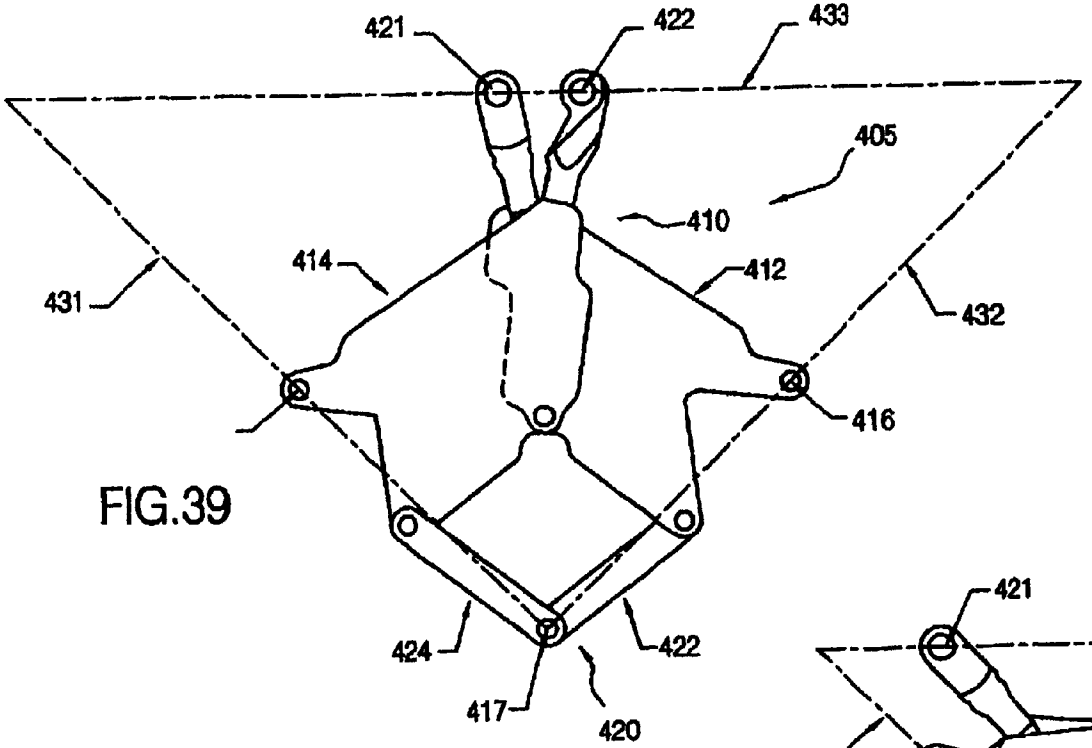
FIG. 39 shows an alternate embodiment of the invention consisting of two scissor pairs forming a four bar linkage.

FIG. 39 shows an alternate embodiment of the invention consisting of two scissor pairs 410 and 420 forming a four bar linkage 405. The relative position of the pivots is identical to linkage 370 shown in FIG. 32, however links 412 and 414 each have an additional pivot, respectively 421 and 422. Lines 433, 431 and 432 drawn between 421, 422 and 415, 417 and 416, 417 respectively may be seen to form a right triangle.

Figure 40:
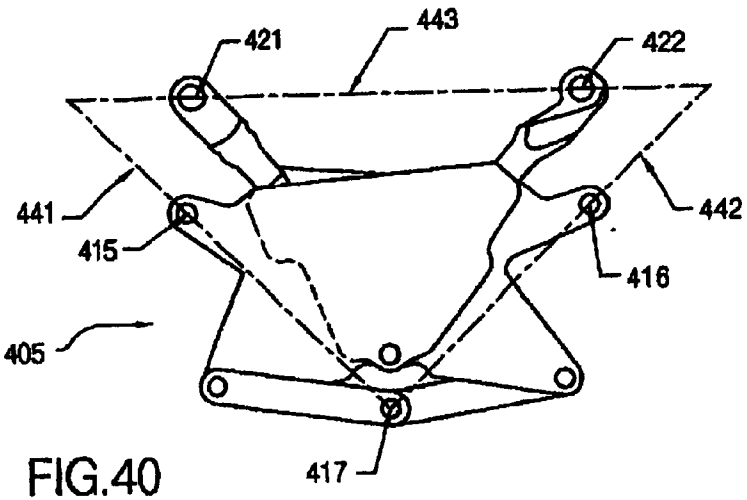
FIG. 40 shows the linkage of FIG. 39 in a folded position.

FIG. 40 shows linkage 405 in a folded position. The triangle formed by lines passing through 421, 422 and 415, 417 and 416, 417 respectively is similar to that formed in FIG. 39, but of different size.

FIG. 41 shows a four-sided linkage 500 in a folded position. FIG. 42 shows linkage 500 in an opened position. Central scissor pair 505 may be seen to drive linkage 500 by a relative rotation between each of its links.

FIGS. 43 and 44 show perspective views of linkage 500 in two positions.

Figure 46:
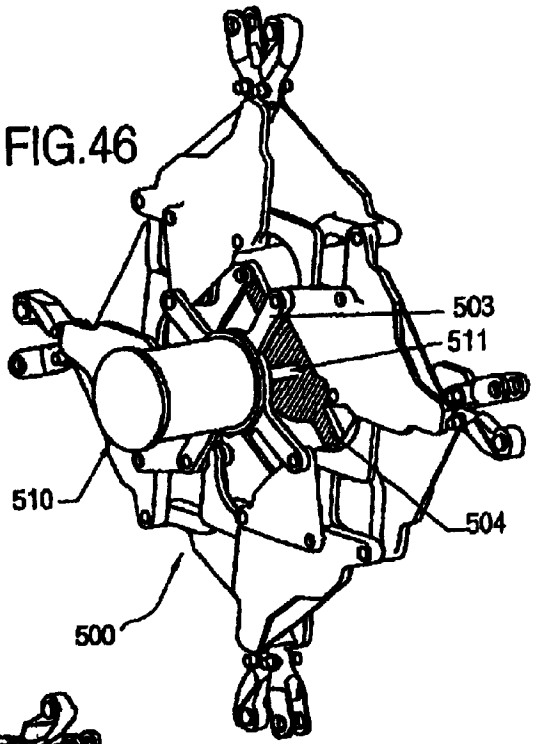
FIG. 46 shows the linkage of FIG. 41 in its assembled form, where the motor has been joined to the central link and the shaft is fixed to the central link.
Figure 45:
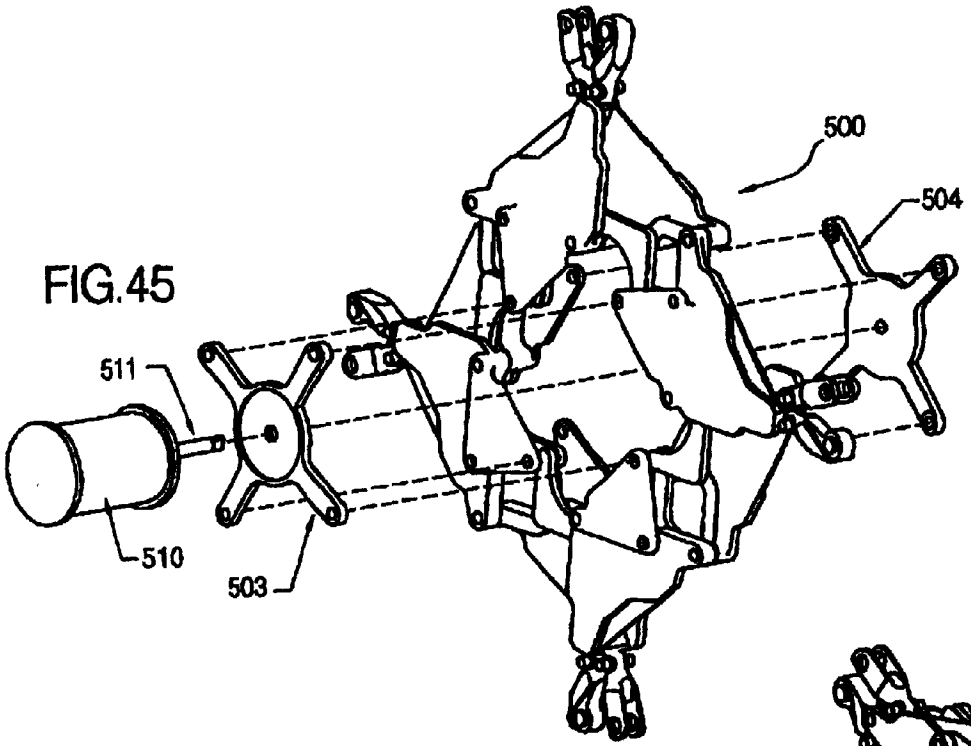
FIG. 45 shows an exploded view of the linkage of FIG. 41 in an open position, with a motor shown ready to be attached to the central link.

FIG. 45 shows an exploded view of linkage 500 in an open position, with motor 510 shown ready to be attached to central link 503. FIG. 46 shows 500 in its assembled form, where motor 510 has been joined to central link 503 and the shaft 511 being fixed to central link 504.

Figure 47:
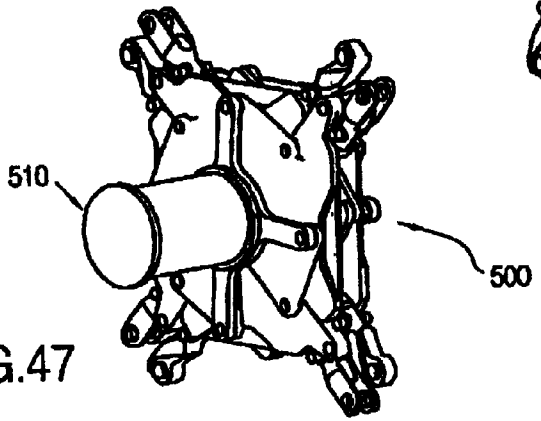
FIG. 47 shows the linkage of FIG. 41 in its closed position, the shaft having been rotated and driving the entire linkage.

In FIG. 47 linkage 500 is shown in its closed position, the shaft 511 having been rotated and thereby driving the entire linkage.

It will be appreciated that the instant specification, drawings and claims set forth by way of illustration and not limitation, and that various modification and changes may be made without departing from the spirit and scope of the present invention.

What is claimed is:

1. A reversibly expandable loop assembly comprising a four bar linkage defined by four links, each of said links being pivotally connected to two other of said links;

wherein two of the said four links are defined as three pivot links having at least a pair of base end pivots and an apex pivot which together define vertices of an isosceles triangle;

wherein said three pivot links are pivotally connected to one another at a first connecting pivot;

wherein said apex pivot of each of said three pivot links is pivotally connected to one of the remaining two links;

wherein each of the remaining two links are pivotally connected to one another at a second connecting pivot;

wherein said four bar linkage is constructed such that the three pivot link base end pivots located away from said first connecting pivot and said second connecting pivot of the remaining two links together define a pair of lines which form an angle that remains constant for any relative rotational position of the linkage.

2. The assembly of claim 1, wherein said four bar linkage includes four pivot points in order to define a parallelogram.

3. The assembly of claim 1, wherein said four bar linkage includes four pivot points which define a rhomb.

4. The assembly of claim 1, wherein one of said three pivot links is connected to the other of said three pivot links at one of the base end pivots of each.

5. A perimeter linkage system comprising a plurality of pivotally connected expandable loop assemblies defined in accordance with claim 1.

6. The assembly of claim 1, wherein each of said three pivot links is pivotally joined at said apex pivot to a first pivot of one of the remaining links.

7. The assembly of claim 6, wherein each of said remaining two links includes a second pivot pivotally joined together.

8. A reversibly expandable loop assembly comprising a four bar linkage consisting of four links, each of said links being pivotally connected to two other of said links;

wherein two of said four links are defined as four pivot links having a pair of base end pivots, a base middle pivot and an apex pivot which together define vertices of two mirrored isosceles triangles;

wherein said four pivot links are pivotally connected to one another at a first connected pivot;

wherein said apex pivots of each of said four pivot links are each pivotally connected to one of the remaining two links;

wherein each of the remaining two links are pivotally connected to one another at a second connecting pivot;

wherein the second connecting pivot of the remaining two links and the base end pivots of said four pivot links define a pair of lines which form an angle that remains constant for any relative rotational position of said linkage.

9. The assembly of claim 4, wherein each of said four pivot links is pivotally connected to the other four pivot link at the base middle pivots.

10. A perimeter linkage system comprising a plurality of pivotally connected expandable loop assemblies defined in accordance with claim 8.

11. The assembly of claim 8, wherein each of said four pivot links is pivotally joined at said apex pivot to a first pivot of one of the remaining two links.

12. The assembly of claim 11, wherein each of the remaining two links includes a second pivot pivotally joined together.

13. A reversibly expandable loop assembly comprising a linkage defined by four links;

wherein two of said four links are defined as two three pivot perimeter links each having a pair of base end pivots and an apex pivot which together define vertices of an isosceles triangle;

wherein said three pivot perimeter links are pivotally connected to one another by means of a third connecting link;

wherein said remaining link is defined as a first centrally located link such that said apex pivot of each of said three pivot perimeter links is pivotally connected to said centrally located link.

14. The assembly of claim 13, wherein said third connecting link has a pair of base end pivots and wherein one of said two three pivot links is pivotally connected to one of said third connecting link base end pivots and said other of said two three pivot links is pivotally connected to the other of said third connecting link base end pivots.

15. The assembly of claim 14, wherein one of said base end pivots of each of said two three pivot links is pivotally connected to a different base end pivot of said third connecting link.

16. The assembly of claim 13, wherein said first centrally located link includes two interior pivots one pivotally connected to the apex pivot one of said two three pivot perimeter links and the other pivotally connected to the apex pivot of the other of said two three pivot perimeter links.

17. The assembly of claim 14, wherein said third connecting link comprises a third three pivot perimeter link having said pair of base end pivots and an apex pivot which together define the vertices of an isosceles triangle.

18. The assembly of claim 17, wherein said third three pivot perimeter link is pivotally connected at one of its base end pivots to a base end pivot one of said two three pivot perimeter links and at the other of its base end pivots to a base end pivot of the other of said two three pivot perimeter links.

19. The assembly of claim 17, wherein said apex pivot of said third three pivot link is pivotally connected to an interior pivot of a second centrally located link.

20. The assembly of claim 19, wherein said second centrally located link has a central pivot pivotally attached to a central pivot of said first centrally located link.

* * * * *